US008926479B2

(12) United States Patent
Chen et al.

(10) Patent No.: US 8,926,479 B2
(45) Date of Patent: Jan. 6, 2015

(54) COLLAPSIBLE MECHANISM FOR TREADMILL

(75) Inventors: Ming-Nan Chen, ChangHua County (TW); Hsuan-Fu Huang, ChangHua County (TW)

(73) Assignee: Dyaco International Inc., Taipei (TW)

( * ) Notice: Subject to any disclaimer, the term of this patent is extended or adjusted under 35 U.S.C. 154(b) by 326 days.

(21) Appl. No.: 13/493,732

(22) Filed: Jun. 11, 2012

(65) Prior Publication Data

US 2013/0237381 A1 Sep. 12, 2013

(30) Foreign Application Priority Data

Mar. 6, 2012 (TW) ..... 101107544 A

(51) Int. Cl.
*A63B 22/02* (2006.01)

(52) U.S. Cl.
USPC ..... 482/54; 292/137; 292/163; 292/138

(58) Field of Classification Search
CPC ..... A63B 2210/50; A63B 22/0046; B62K 15/006; F16B 37/0857; F16B 19/109
USPC ..... 482/54, 908; 292/60, 62, 137, 163, 164, 292/174, 175, 176, 138, 145, 146, 148, 149, 292/150, 151, 152, 155, 277, 300, 302, 303, 292/DIG. 30, DIG. 37; 297/378.12, 313; 182/91; 280/87.05; 403/98, 325
See application file for complete search history.

(56) References Cited

U.S. PATENT DOCUMENTS

| | | | | |
|---|---|---|---|---|
| 2,497,026 | A * | 2/1950 | Fox | 292/227 |
| 3,554,585 | A * | 1/1971 | Sorenson | 403/105 |
| 3,847,422 | A * | 11/1974 | Gulistan | 292/60 |
| 5,344,372 | A * | 9/1994 | Hung | 482/54 |
| 5,433,552 | A * | 7/1995 | Thyu | 403/378 |
| 5,586,852 | A * | 12/1996 | Ganter | 411/353 |
| 6,090,016 | A * | 7/2000 | Kuo | 482/54 |
| 6,173,976 | B1 * | 1/2001 | Lee | 280/87.05 |
| 6,206,387 | B1 * | 3/2001 | Tsai | 280/87.041 |
| 6,234,501 | B1 * | 5/2001 | Chen | 280/87.041 |
| 6,299,223 | B1 * | 10/2001 | Ji et al. | 292/175 |
| 6,390,483 | B1 * | 5/2002 | Hsu et al. | 280/87.041 |

(Continued)

FOREIGN PATENT DOCUMENTS

| | | |
|---|---|---|
| CN | 201625371 U | 11/2010 |
| TW | M339319 | 1/2008 |
| TW | M339329 | 9/2008 |
| TW | I303571 | 12/2008 |

*Primary Examiner* — Loan H Thanh
*Assistant Examiner* — Joshua Lee
(74) *Attorney, Agent, or Firm* — Huffman Law Group, PC

(57) ABSTRACT

A collapsible mechanism for a treadmill is composed of a support frame, a stand, and an operational console. The stand includes a frame body, a first positioning assembly, and a second positioning assembly. The frame body has a bottom side pivotably attached to the support frame in such a way that the frame body is collapsible relative to the frame. The first and second positioning assemblies are connected with the frame body and the support frame separately. Each of the first and second positioning assemblies includes a first (second) fastener and a first (second) sheet member. The first and second fasteners are inserted through the first and second sheet members separately. Each of the first and second sheet members includes two first specific positions. The operational console is pivotably attached to a top side of the frame body and collapsible relative to the stand.

3 Claims, 15 Drawing Sheets

(56) References Cited

U.S. PATENT DOCUMENTS

| | | | | |
|---|---|---|---|---|
| 6,592,500 | B1 * | 7/2003 | McBride et al. | 482/140 |
| 7,011,319 | B2 * | 3/2006 | Lu | 280/87.041 |
| 7,198,306 | B2 * | 4/2007 | Ambs | 292/175 |
| 7,540,829 | B1 * | 6/2009 | Chen | 482/54 |
| 7,815,227 | B2 * | 10/2010 | Jan et al. | 292/27 |
| 8,585,561 | B2 * | 11/2013 | Watt et al. | 482/57 |
| 8,702,046 | B2 * | 4/2014 | Cooper | 248/125.8 |
| 2002/0017768 | A1 * | 2/2002 | Nardone | 280/87.041 |
| 2002/0140193 | A1 * | 10/2002 | Chai | 280/87.041 |
| 2002/0159860 | A1 * | 10/2002 | Kienzler | 411/352 |
| 2003/0060331 | A1 * | 3/2003 | Polk et al. | 482/20 |
| 2005/0192162 | A1 * | 9/2005 | Pan et al. | 482/54 |
| 2006/0003869 | A1 * | 1/2006 | Huang et al. | 482/54 |
| 2006/0122037 | A1 * | 6/2006 | Chou Lin | 482/54 |
| 2006/0122038 | A1 * | 6/2006 | Chou Lin | 482/54 |
| 2006/0160665 | A1 * | 7/2006 | Tai | 482/54 |
| 2007/0066448 | A1 * | 3/2007 | Pan et al. | 482/54 |
| 2007/0225135 | A1 * | 9/2007 | Webber | 482/140 |
| 2007/0281835 | A1 * | 12/2007 | Baker | 482/57 |
| 2009/0005224 | A1 * | 1/2009 | Davis et al. | 482/54 |
| 2009/0008187 | A1 * | 1/2009 | Garelick | 182/91 |
| 2009/0042698 | A1 * | 2/2009 | Wang | 482/54 |
| 2009/0111666 | A1 * | 4/2009 | Wang | 482/54 |
| 2009/0163327 | A1 * | 6/2009 | Huang et al. | 482/54 |
| 2009/0280964 | A1 * | 11/2009 | Chen | 482/54 |
| 2011/0021323 | A1 * | 1/2011 | Wu | 482/54 |
| 2011/0316247 | A1 * | 12/2011 | Johnson | 280/87.05 |
| 2012/0018969 | A1 * | 1/2012 | Cho | 280/87.041 |
| 2012/0283070 | A1 * | 11/2012 | Lai et al. | 482/54 |

* cited by examiner

COLLAPSIBLE MECHANISM FOR TREADMILL

BACKGROUND OF THE INVENTION

1. Field of the Invention

The present invention relates generally to a treadmill and more particularly, to a collapsible mechanism for a treadmill.

2. Description of the Related Art

As the life is busy and the time for outdoor exercise like jogging is less sufficient, the treadmill becomes popular to gradually take place of outdoor jogging. However, the conventional treadmill is usually bulky to be less convenient for storage. Thus, many treadmills have been designed to be collapsible so far, e.g. Taiwan Patent Nos. I303571 and M339319, for less storage space.

In one of the aforesaid two patents, Taiwan Patent No. I303571 disclosed a treadmill which can be collapsed flatly and includes a support frame and a rotatable stand. When the rotatable stand lies against the support frame, the treadmill becomes flatly collapsed. It further disclosed a console of an auxiliary assembly extending forward and upward integrally from a support end of the stand at the angle of 45 degrees. Thus, when the treadmill is collapsed, the console cannot be effectively collapsed to cause inconvenient storage.

SUMMARY OF THE INVENTION

The primary objective of the present invention is to provide a collapsible mechanism, whose stand can be horizontally collapsed to lie on a support frame thereof to make the treadmill be flatly collapsed.

The secondary objective of the present invention is to provide a collapsible mechanism, whose operational console can be collapsed to make the treadmill be small-sized and compact.

The foregoing objectives of the present invention are attained by the collapsible mechanism composed of a support frame, a stand, and an operational console. The stand is pivotably attached to the support frame and includes a frame body, a first positioning assembly, and a second positioning assembly. The frame body has a bottom side pivotably attached to the support frame in such a way that the frame body is collapsible relative to the frame. The first and second positioning assemblies are connected with the frame body and the support frame separately and located at a bottom side of the frame body. The first positioning assembly includes a first fastener and a first sheet member. The second positioning assembly includes a second fastener and a second sheet member. The first and second fasteners are inserted through the first and second sheet members separately. Each of the first and second sheet members includes a first specific position. When each of the first and second fasteners is located at one of the specific positions of the first (second) sheet member, the stand is set erect relative to the support frame. When the first and second fasteners are located at the other specific position of the first (second) sheet member, the stand is collapsed relative to the support frame. The operational console is pivotably attached to a top side of the frame body and collapsible relative to the stand.

DETAILED DESCRIPTION OF PREFERRED EMBODIMENTS

Figure 1:
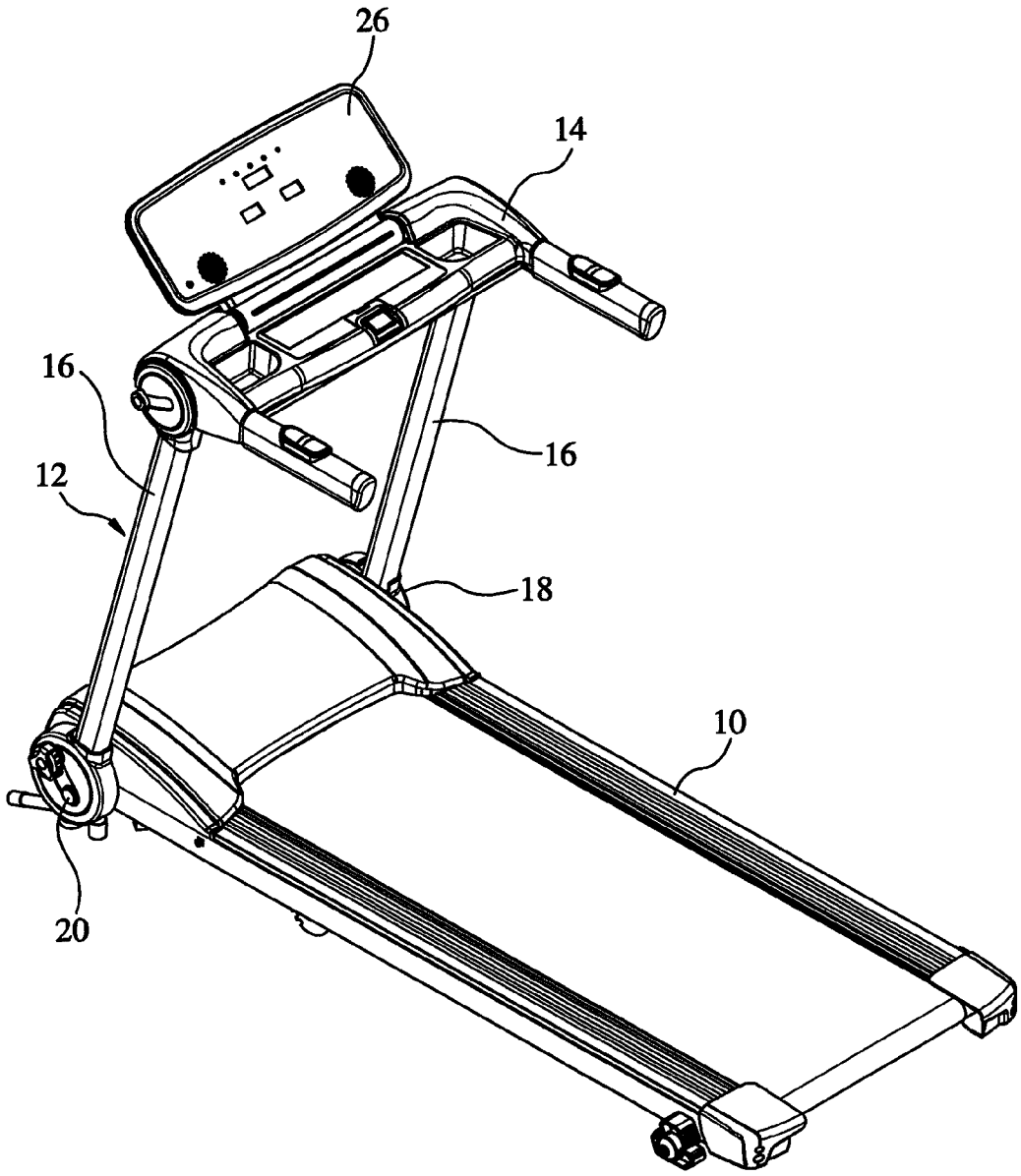
FIG. 1 is a perspective view of a first preferred embodiment of the present invention.
Figure 2:
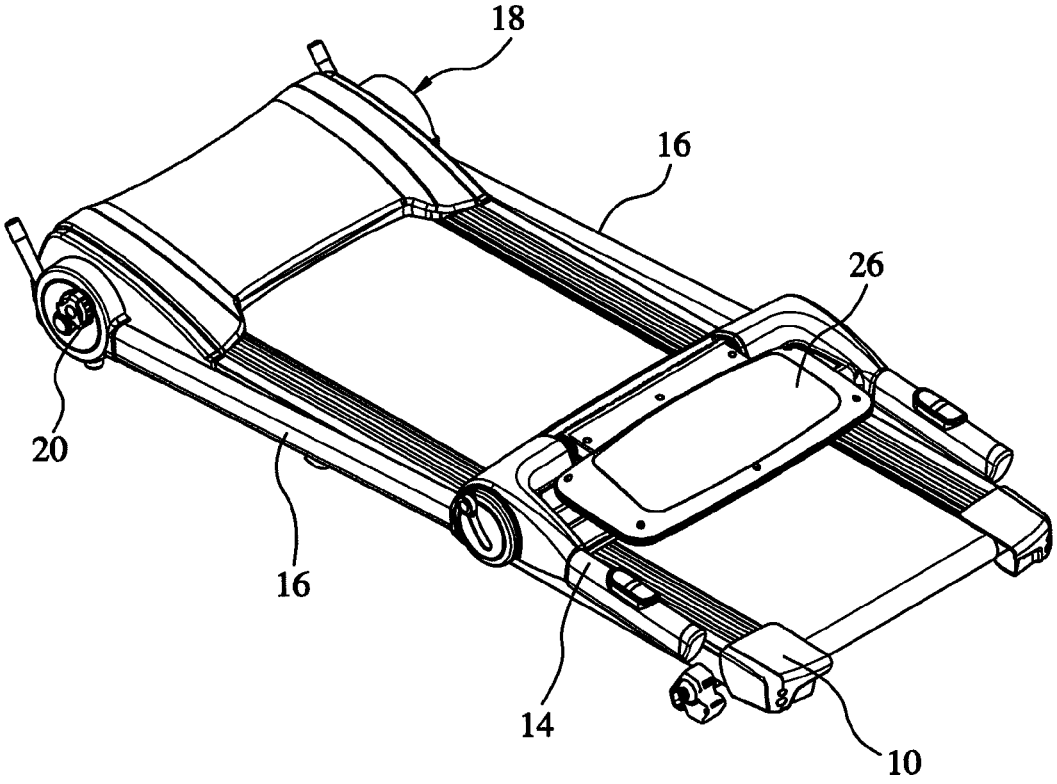
FIG. 2 is another perspective view of the first preferred embodiment of the present invention, in which the stand is collapsed.

Referring to FIGS. 1-2, a collapsible mechanism for a treadmill in accordance with a first preferred embodiment of the present invention is composed of a support frame 10, a stand 12, and an operational console 14. A user can jog or run on the support frame 10. Since there are various kinds and types of the support frame 10, more detailed descriptions are skipped for the support frame 10. The detailed descriptions and operations of these elements as well as their interrelations are recited in the respective paragraphs as follows.

The stand 12 is pivotably attached to the support frame 10 and includes a frame body 16, a first positioning assembly 18, and a second positioning assembly 20. The frame body 16 is provided with a bottom side pivotably attached to the support frame 10 for enabling the frame body 16 to be collapsible with respect to the support frame 10, as shown in FIG. 2.

Figure 3:
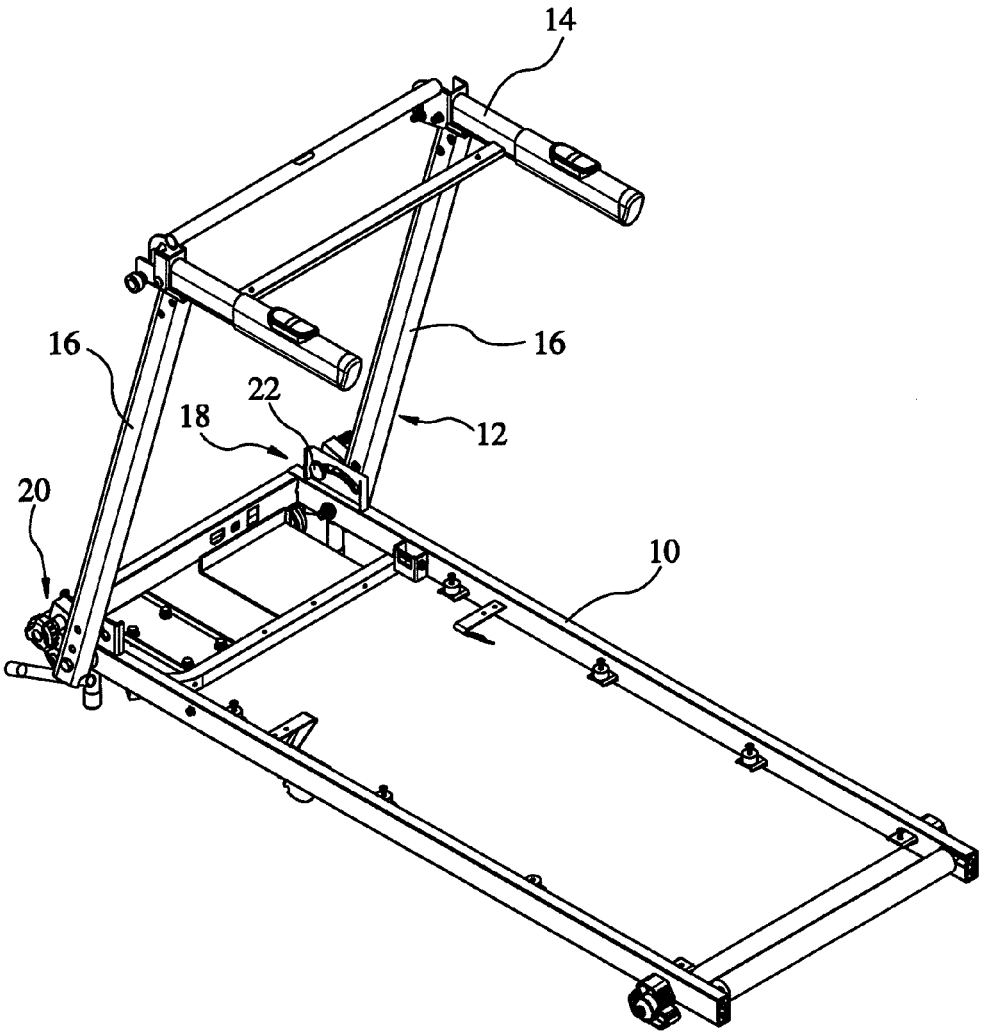
FIG. 3 is a skeletonic perspective view of the first preferred embodiment of the present invention shown in FIG. 1.
Figure 4:
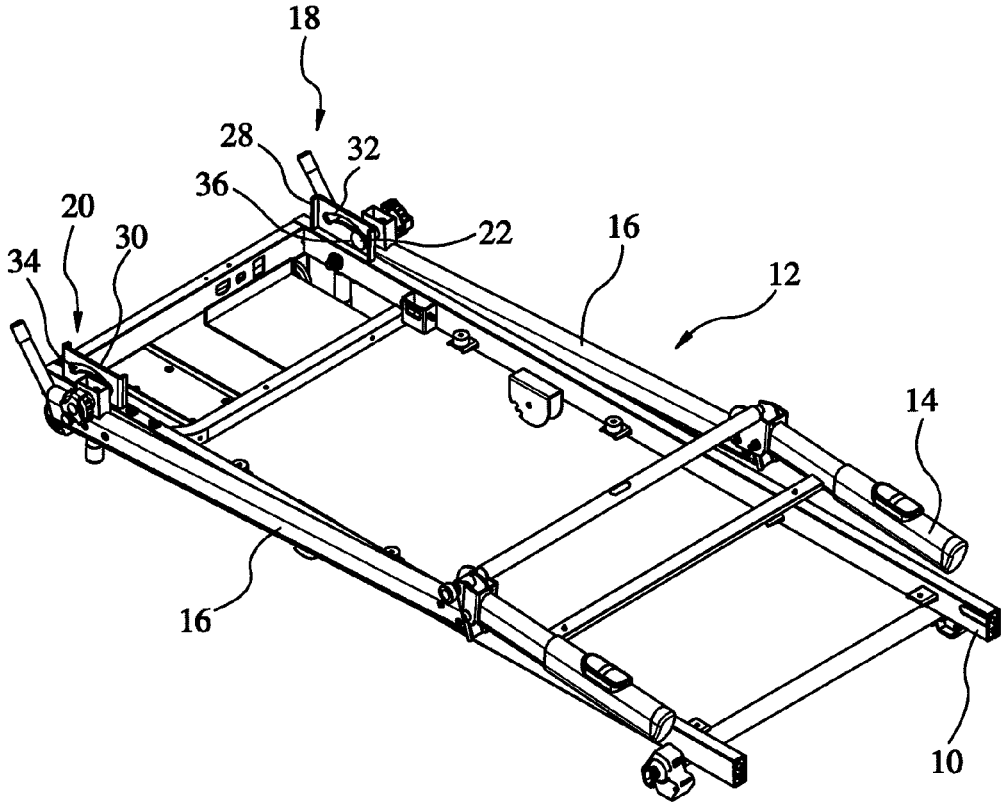
FIG. 4 is a skeletonic perspective view of the first preferred embodiment of the present invention shown in FIG. 2.

Referring to FIGS. 3-4, the frame body 16 is formed of two support struts located at two sides of the support frame 10 separately. However, the frame body 16 can actually have alternative patterns. The first and second positioning assemblies 18 and 20 are connected with the frame body 16 and the support frame 10 separately and located at the bottom side of the frame body 16. The first positioning assembly 18 includes a first fastener 22 and a first sheet member 28. The second positioning assembly 20 includes a second fastener 24 and a second sheet member 30. The first and second fasteners 22 and 24 are inserted through the first and second sheet members 28 and 30. Each of the first and second sheet members 28 and 30 has two first specific positions. Each of the first and second fasteners 22 and 24 are located at one of the two first specific positions of the first (second) sheet members 28(30), the stand 12 is set erect with respect to the support frame 10, as shown in FIGS. 1 and 3. When each of the first and second fasteners 22 and 24 are located at the other specific position of the first or second sheet members 28 and 30, the stand 12 is set collapsed with respect to the support frame 10, as shown in FIGS. 2 and 4.

The operational console 14 is pivotably attached to a top side of the frame body 16 and can be collapsed with respect to the frame body 16. The operational console 14 is usually installed with an operating device 26, as shown in FIGS. 1-2. The operating device 26 can usually control and record the status of the support frame 10. The operating device 26 can be inputted via a touch panel or keyboard.

Figure 5:
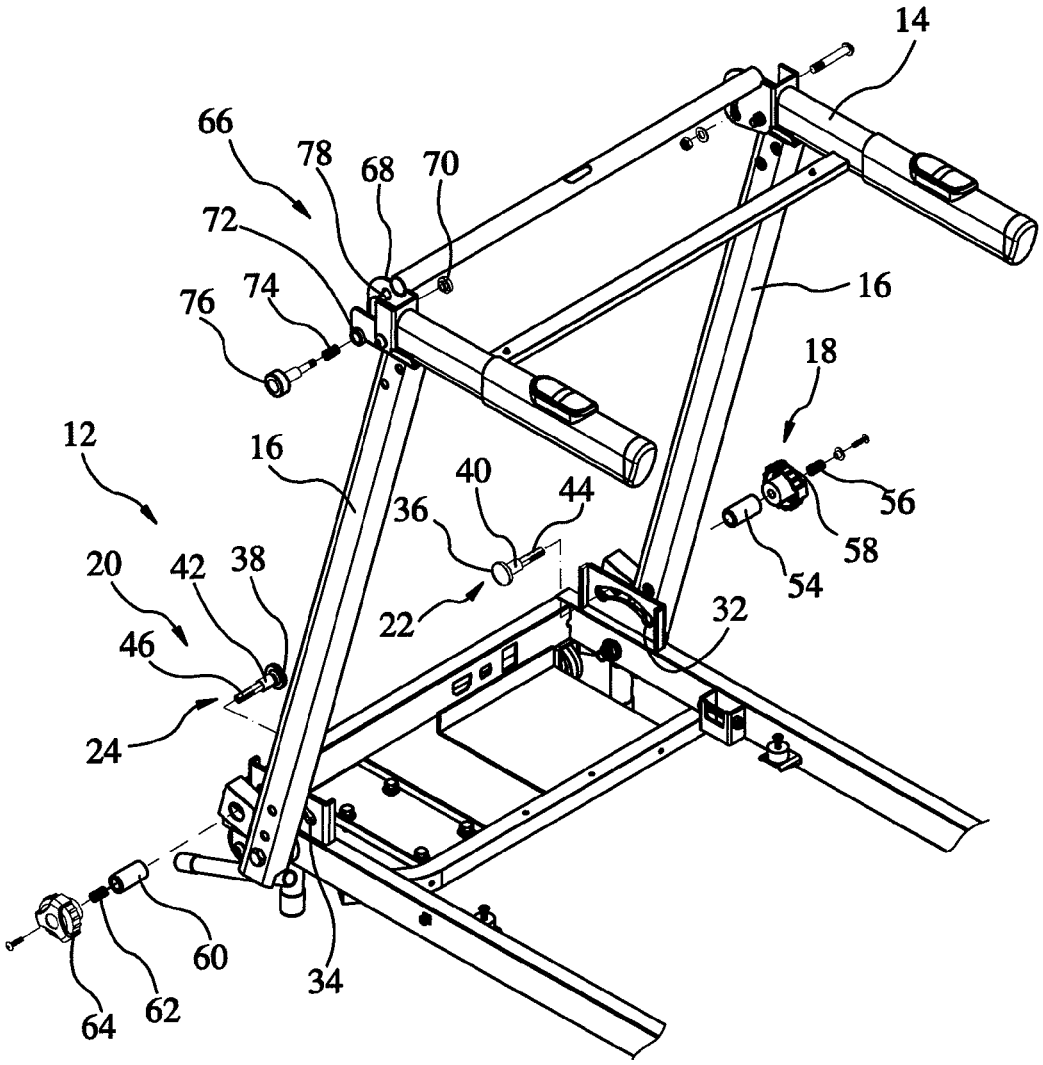
FIG. 5 is a partially exploded view of the first preferred embodiment of the present invention.

Referring to FIGS. 4-5, each of the first and second sheet members 28 and 30 includes an arc-shaped guide slot 32(34). Each of climaxes of the arc-shaped guide slots 32 and 34 is close to a top side of the first (second) sheet member 28(30). Each of the arc-shaped guide slots 32 and 34 has a front end and a rear end which are close to a front side and a rear side of one of the first and second sheet members 28 and 30 separately. Respective bottom sides of the first and second sheet members 28 and 30 are connected with the support frame 10. The first and second fasteners 22 and 24 are mounted to the frame body 16 and pass through the arc-shaped guide slots 32 and 34 separately. Each of the first and second fasteners 22 and 24 has a head portion 36(38), a neck portion 40(42), and a body portion 44(46). Each of the head portions 36 and 38 is located at one of two sides of the first (second) sheet members 28(30). When each of the neck portions 40 and 42 is located at one of the two specific positions of the arc-shaped guide slot 32(34), the frame body 16 is set fixedly erect or horizontal. When each of the neck portions 40 and 42 is located at one of the two specific positions of the arc-shaped guide slot 32(34), the frame body 16 is set fixedly erect or horizontal. When each of the body portions 44 and 46 is located at the other side of the first (second) sheet members 28(30), the frame body 16 can move along the two arc-shaped guide slots 32 and 34.

Figure 6:
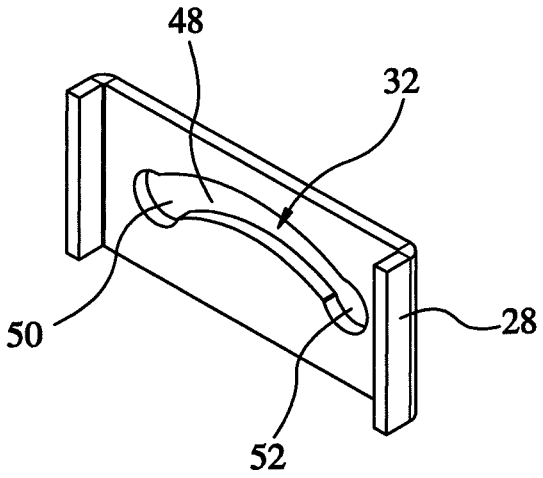
FIG. 6 is a perspective view of a part of the first preferred embodiment of the present invention.

Referring to FIG. 6, the arc-shaped guide slot 32 of the first sheet member 28 is provided with a guide portion 48 and two positioning portions 50 and 52 located at two distal ends of the guide portion 48 separately. The two positioning portions 50 and 52 are the two first specific positions mentioned above. The second sheet member 30 is structurally identical to the first sheet member 28, so its detailed description is skipped. Each of the neck portions 40 and 42 of the first and second fasteners 22 and 24 can be plugged into one of the two positioning portions 50 and 52 to be positioned in such a way that the body portions 44 and 46 can move along the guide portion 48. If the two arc-shaped guide slots 32 and 34 have more positioning portions, the stand 2 can be positioned to other locations.

Referring to FIG. 5 again, the first positioning assembly 18 further includes a first sleeve 54, a first spring 56, and a first operational knob 58. The first spring 56 is mounted inside the first sleeve 54. The body portion 44 of the first fastener 22 is located inside the first sleeve 54, passing through the first sleeve 54, and threadably secured to an internal wall of the first sleeve 54. The first fastener 22 is movable with respect to the first sleeve 54. The body portion 44 of the first fastener 22 is connected with the first operational knob 58.

The second positioning assembly 20 further includes a second sleeve 60, a second spring 61, and a second operational knob 64. The body portion 46 of the second fastener 24 is located inside the second sleeve 60 and passes through the second sleeve 60. The second fastener 24 is movable with respect to the second sleeve 60. The second spring 62 is sleeved onto the body portion 46 of the second fastener 24 and located between the second operational knob 64 and the second sleeve 60.

Figure 7:
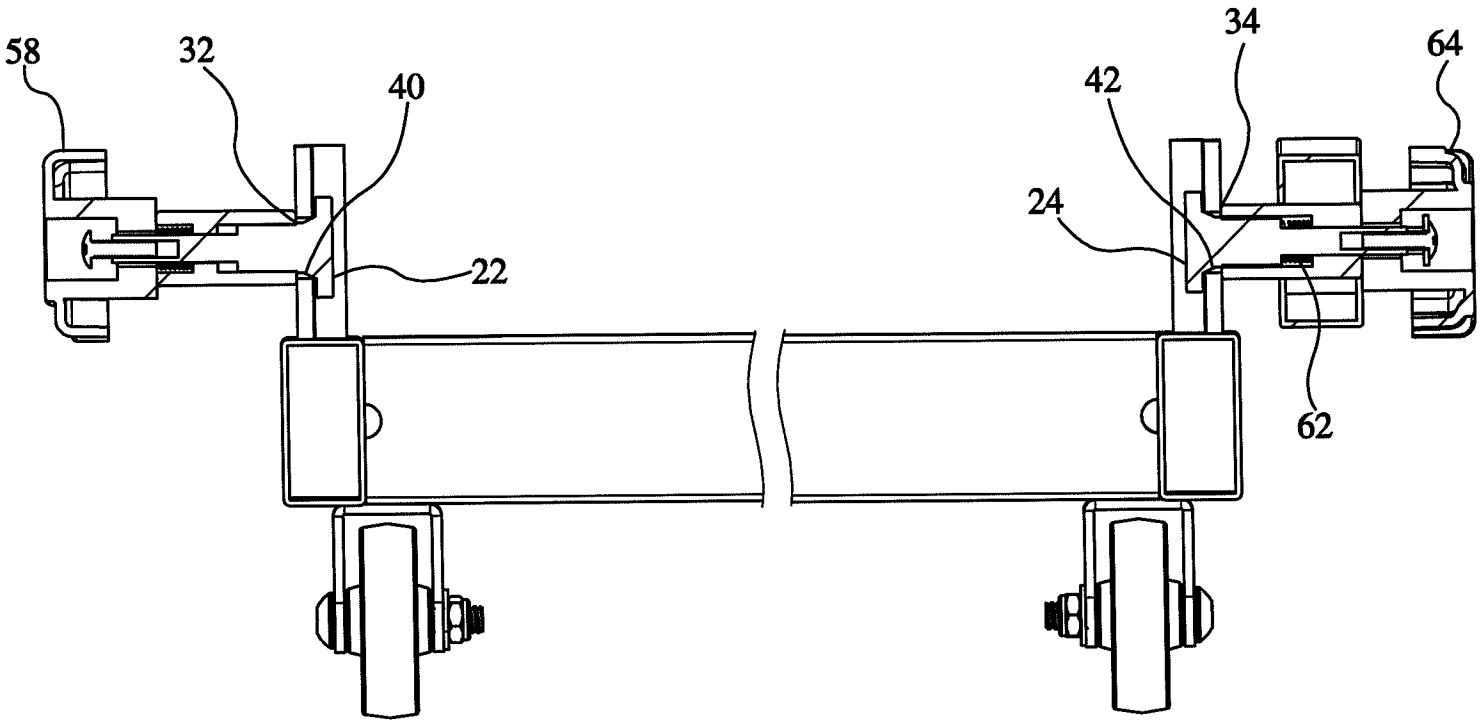
FIGS. 7-9 illustrate the operation of the first and second positioning assembly in accordance with the first preferred embodiment of the present invention.
Figure 8:
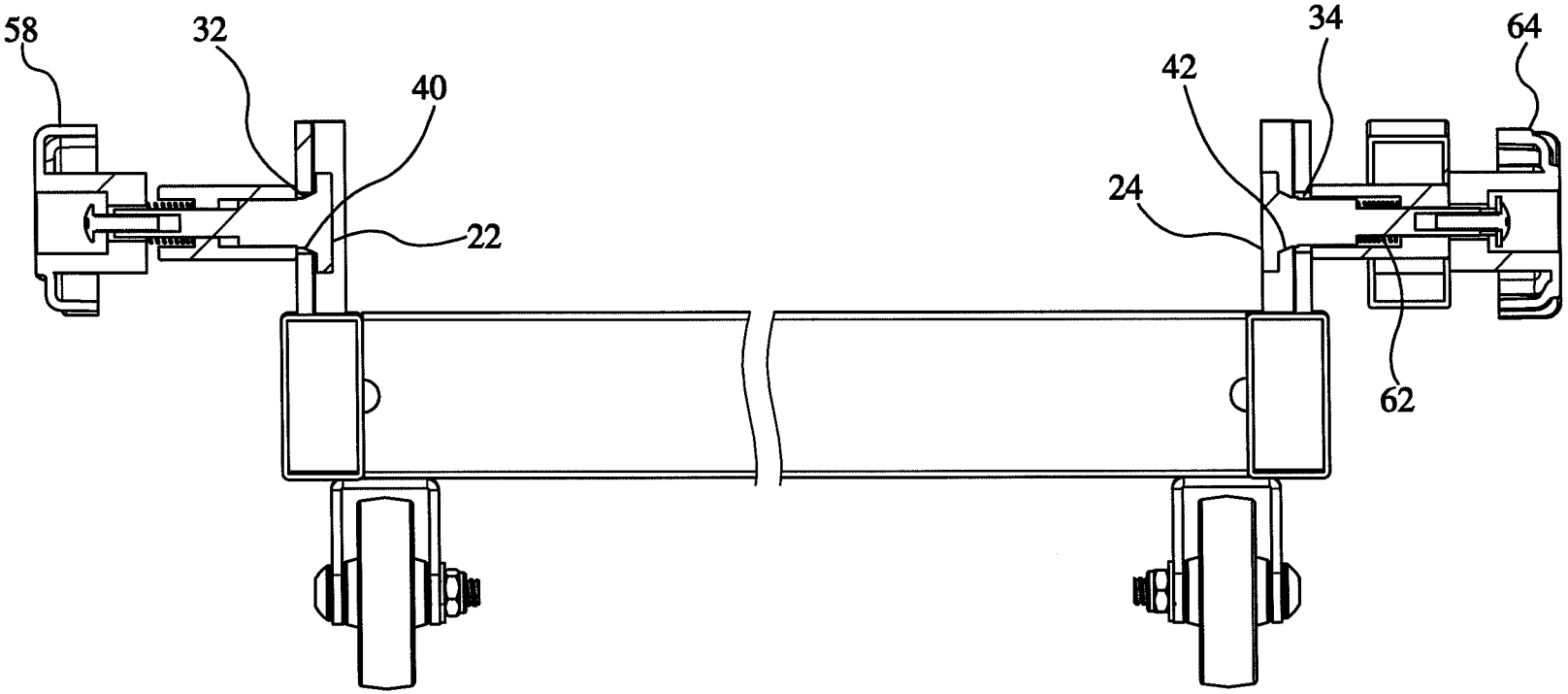
Figure 9:
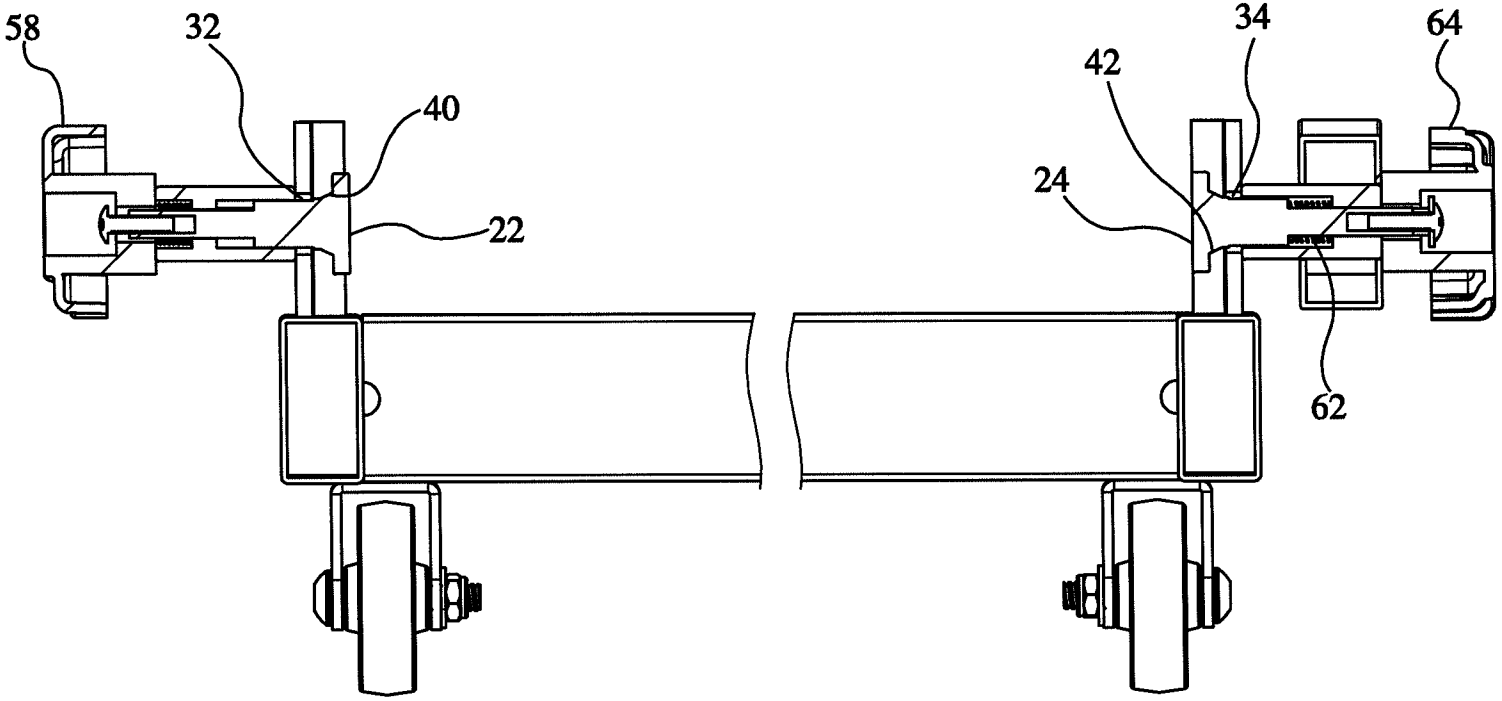

Referring to FIG. 7, when the neck portions 22 and 24 of the first and second fasteners 22 and 24 are located inside the two arc-shaped guide slots 32 and 34 separately, the first and second fasteners 22 and 24 cannot move along the two arc-shaped guide slots 32 and 34 separately. Referring to FIG. 8, when the user rotates the first and second knobs 58 and 64 to enable the second spring 62 to have sufficient space for releasing itself in such a way that the neck portion 42 of the second fastener 24 is forced to exit the arc-shaped guide slot 32 and meanwhile, the neck portion 40 of the first fastener 22 stays in the arc-shaped guide slot 32, indicating that the first fastener 22 still fails to move along the arc-shaped guide slot 34 but the second fastener 24 can move along the arc-shaped guide slot 34. Referring to FIG. 9, if the user rotates the first operational knob 58, the neck portion 40 will be driven to exit the arc-shaped guide slot 32 to enable the first fastener 22 to move along the arc-shaped guide slot 32. In this way, the stand 12 can be collapsed with respect to the support frame 10.

Figure 10:
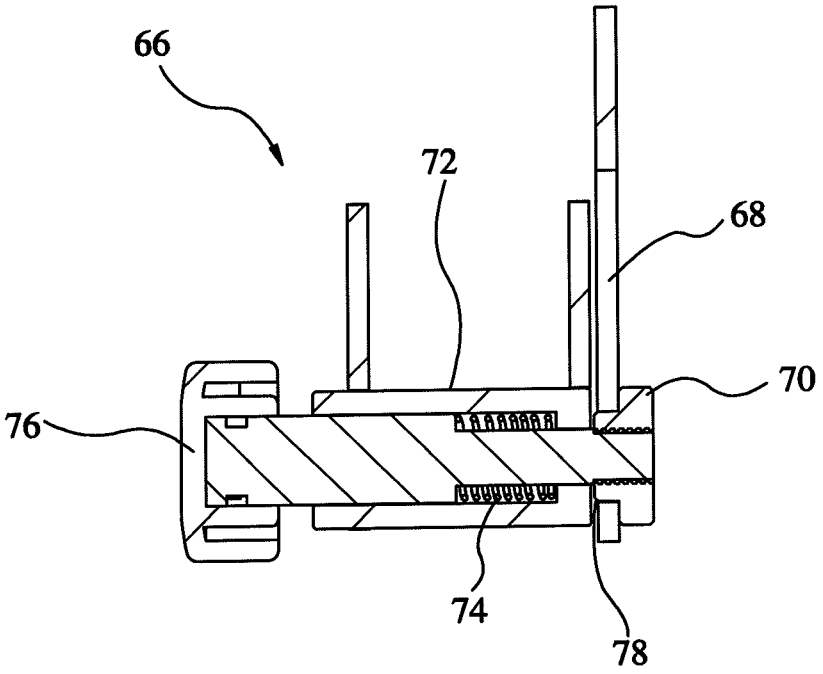
FIGS. 10-11 illustrate the operation of the third positioning assembly in accordance with the first preferred embodiment of the present invention.

Referring to FIG. 10 in view of FIG. 5 again, the stand 12 further includes a third positioning assembly 66 having a third fastener 70 and a third sheet member 68. The third fastener 70 is inserted through the third sheet member 68. The third sheet member 68 has two second specific positions. When the third fastener 70 is located at one of the second specific positions, the operational console 14 is set erect with respect to the stand 12. When the third fastener 70 is located at the other second specific position, the operational console 14 is set collapsed with respect to the stand 12, as shown in FIGS. 3-4. In this way, the treadmill can be collapsed to have the minimum size for convenient storage.

Figure 11:
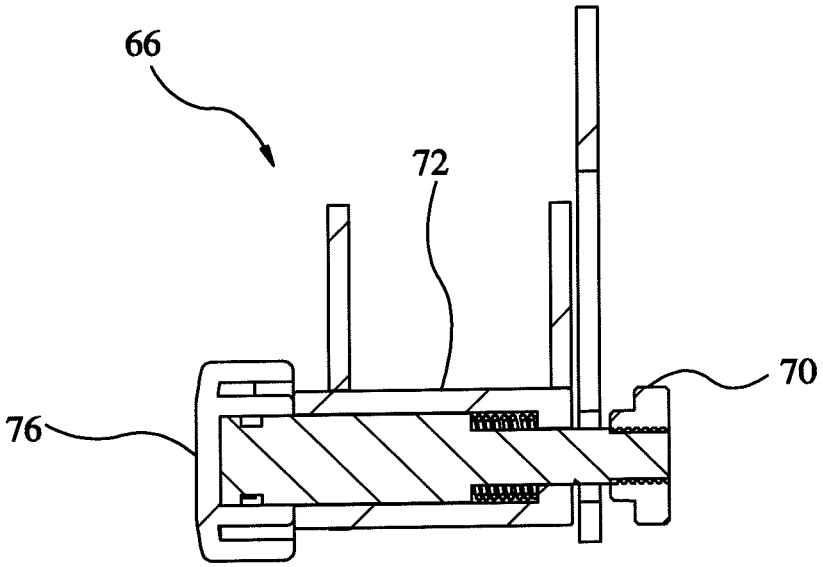
Figure 12:
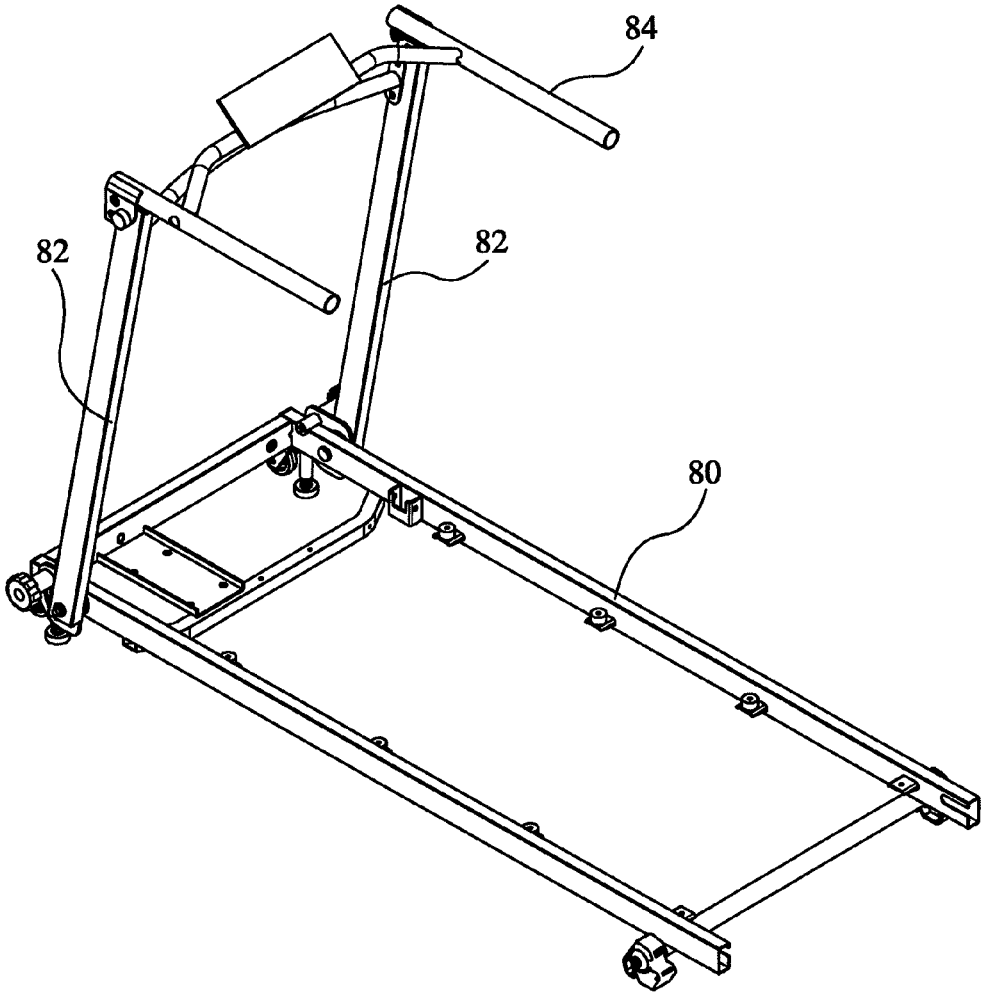
FIG. 12 is a perspective view of a second preferred embodiment of the present invention.

The third positioning assembly 66 further includes a third sleeve 72, a third spring 74, and a third operational knob 76. The third sheet member 68 is connected with the operational console 14 and includes an arc-shaped guide slot 78, which is provided with two distal ends close to a top side and a bottom side of the arc-shaped guide slot 78 separately. The two second specific positions are located at the two distal ends of the arc-shaped guide slot 78 separately. The third fastener 70 is located at one side of the third sheet member 68 and adapted to be plugged into one of the second specific positions of the arc-shaped guide slot 78 of the third sheet member 68. The third sleeve 72 is located at the other side of the third sheet member 68 and fixed onto the frame body 16. The third spring 74 is sleeved onto the third operational knob 76 and located inside the third sleeve 72. As shown in FIG. 10, without any external force, the third operational knob 76 can be forced by the action of the spring 74 to hold the third fastener 70 inside the arc-shaped guide slot 78 of the third sheet member 68, indicating that the operational console 14 is set fixedly collapsed or erect, as shown in FIG. 3 or 4, when the third fastener 70 is located inside the arc-shaped guide slot 78. Referring to FIG. 11, when the user rotates the third operational knob 76, the third fastener 70 can exit the arc-shaped guide slot 78 and the operational console 14 can be collapsed with respect to the stand 12, indicating that the user can adjust the angle of the operational console 14 with respect to the stand 12.

In fact, the second positioning assembly 20 can be structurally replaced by the first or third positioning assembly 18 or 66 for collapsing the stand 12 or the operational console 14. Thus, the first, second, and third positioning assemblies 18, 20 & 66 can structurally work with one another randomly and be not limited to the aforesaid structures.

Referring to FIGS. 12-16, a collapsible mechanism for a treadmill in accordance with a second preferred embodiment of the present invention is composed of a support frame 80, a stand 82, and an operational console 84. How the support frame 80, the stand 82, and the operational console 84 are operated is identical to that of the first embodiment, so no more recitation is necessary.

Figure 13:
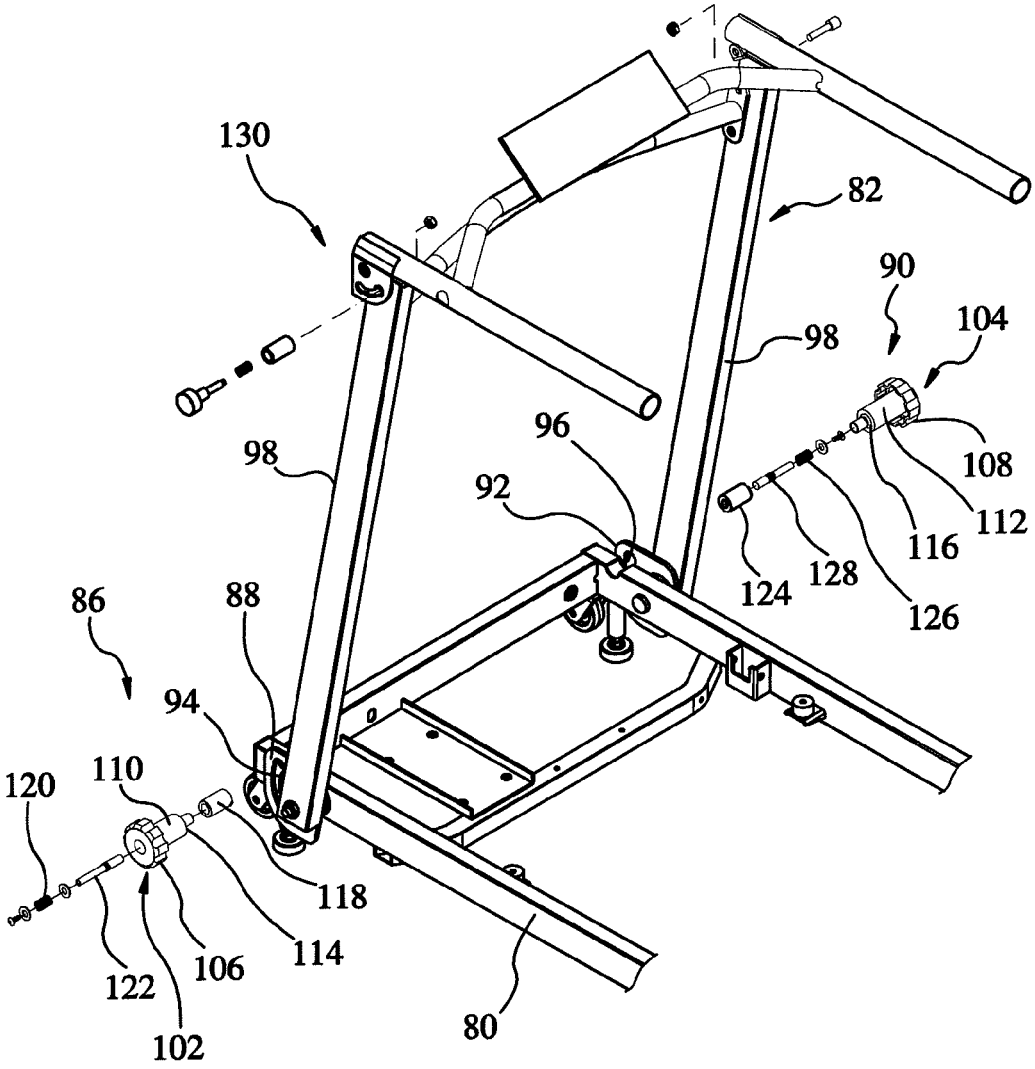
FIG. 13 is an exploded view of the second preferred embodiment of the present invention.

It is to be noted that the first positioning assembly 86, as shown in FIG. 13, further includes a first sheet member 88. The second positioning assembly 90 further includes a second sheet member 92. Each of the first and second sheet members 88 and 92 has an arc-shaped guide slot 94(96). Respective arc-shaped climaxes of the two arc-shaped guide slots 94 and 96 are close to the front ends of the first and second sheet members 88 and 92 separately. Respective distal ends of each of the arc-shaped guide slots 94 and 96 are close to the top and bottom sides of the first (second) sheet members 88 and 92. The first and second fasteners 102 and 104 are mounted to the support frame 80 and pass through the arc-shaped guide slots 94 and 96 separately. Because the first and second sheet members 88 and 92 are mounted onto the frame body 98, while the collapsible mechanism is collapsed, the first and second sheet members 88 and 92 can move along with the frame body 98. Each of the first and second fasteners 102 and 104 includes a first (second) operational knob 106 (108). Each of the head portions 110 and 112 of the first and second operational knob 106 and 108 is located at one side of the first (second) sheet member 88(92). When each of neck portions 114 and 116 of the first (second) operational knobs 106(108) is located at one of the first specific positions of the arc-shaped guide slot 94(96), the frame body 98 of the stand 82 is set fixedly erect. When each of the neck portions 114 and 116 is located at the other first specific position, the frame body 98 is set fixedly collapsed. When the neck portions 114 and 116 exit the first specific positions of the arc-shaped guide slots 94 and 96 separately, the frame body 98 can move along the arc-shaped guide slots 94 and 96 to make the stand 82 be horizontal from erect or to make the stand 82 be erect from horizontal.

The first positioning assembly 86 further includes a first sleeve 118 and a first spring 120. The first fastener 102 further includes a first link 122 located inside the arc-shaped guide slot 94 of the first sheet member 88. One end of the first link 122 is threadably secured with the first sleeve 118 and located inside the first sleeve 118. The first spring 120 is sleeved onto the first link 122 and located inside the first sleeve 118. The first operational knob 106 is mounted onto the first link 122 and located at the other end of the first link 122, being movable with respect to the first link 122. The second positioning assembly 90 further includes a second sleeve 124 and a second spring 126. The second fastener 104 further includes a second link 128 located inside the arc-shaped guide slot 96 of the second sheet member 92. One end of the second link 128 is threadably secured with the second sleeve 124 and located inside the second sleeve 124. The other end of the second link 128 is inserted through the head portion 112 and the neck portion 116 of the second operational knob 108. The head portion 112 of the second operational knob 108 includes a chamber for receiving the second spring 126 and can move with respect to the second link 128.

Figure 14:
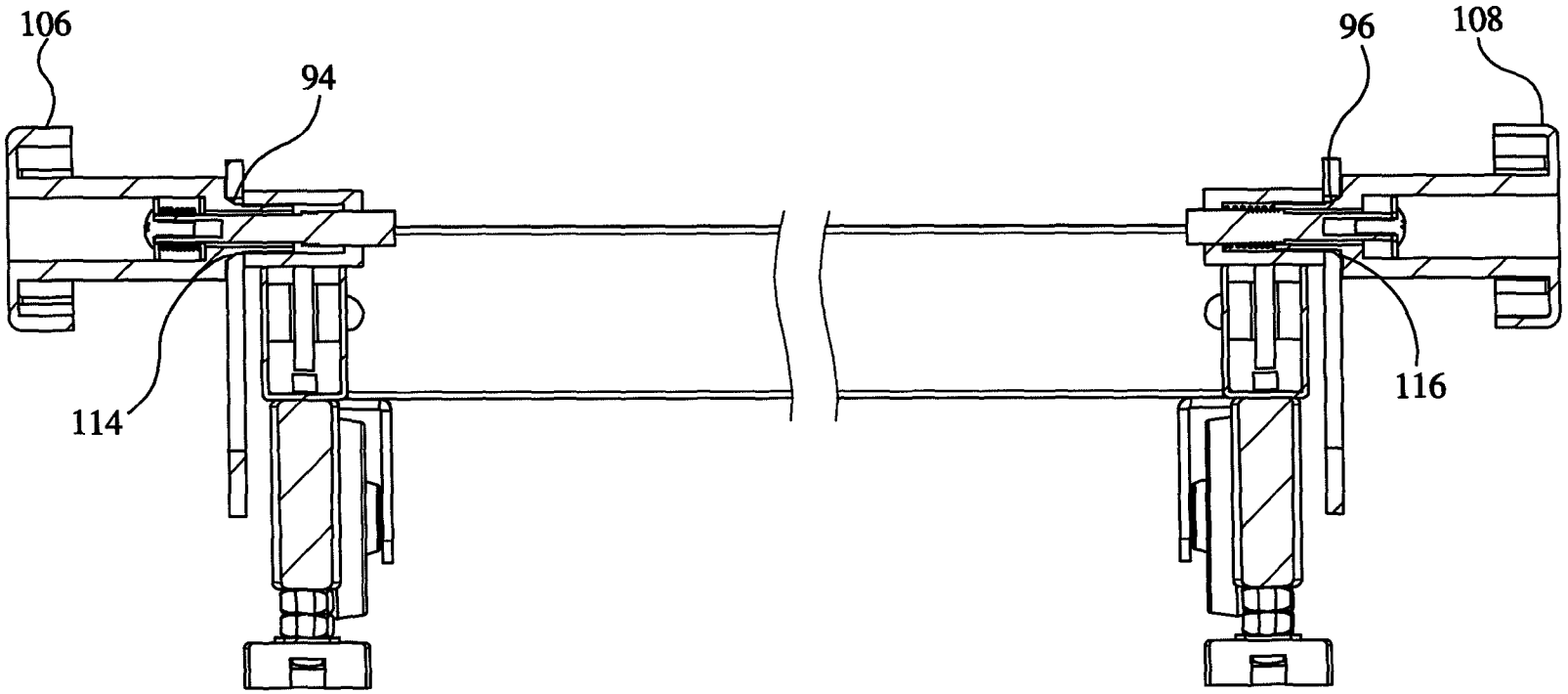
FIGS. 14-16 illustrate the operation of the first and second positioning assembly in accordance with the second preferred embodiment of the present invention.
Figure 15:
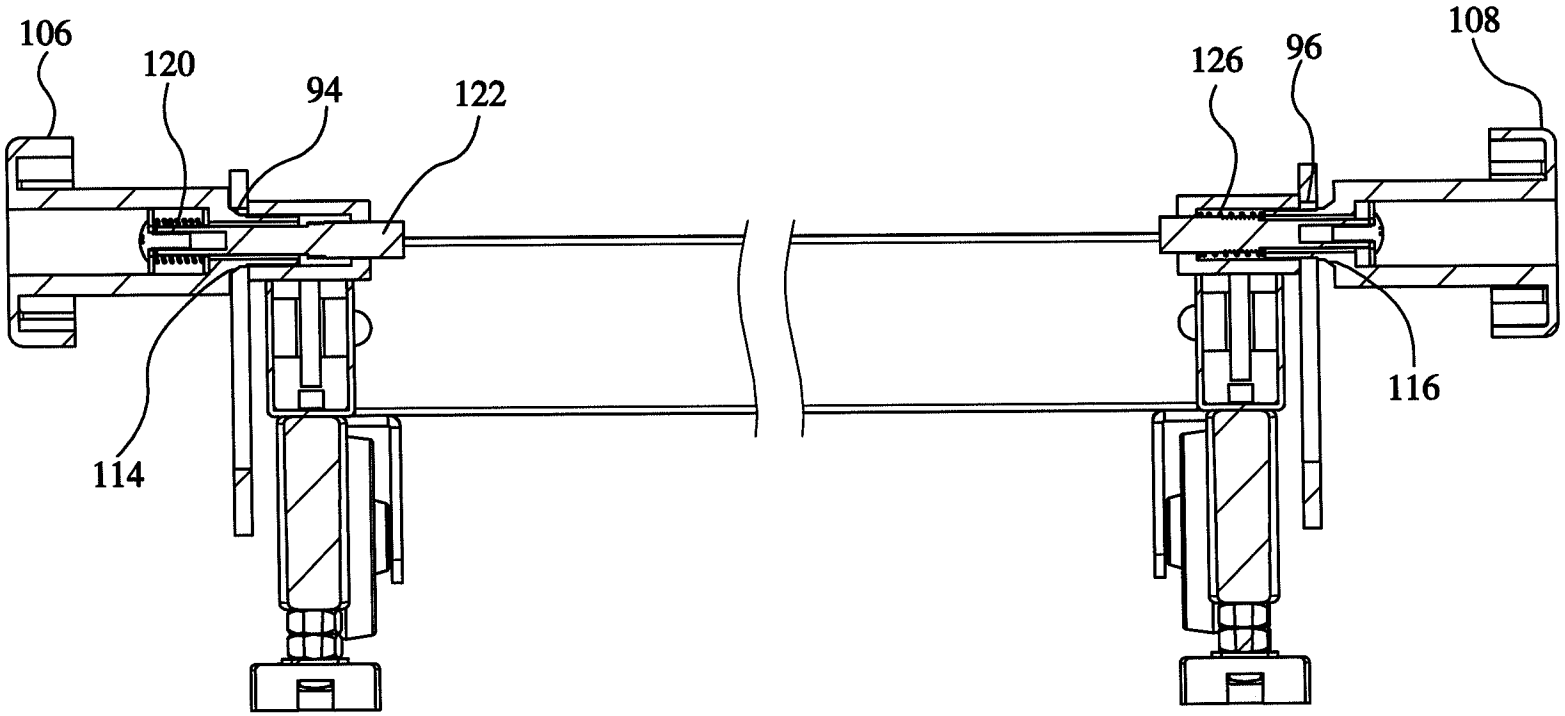
Figure 16:
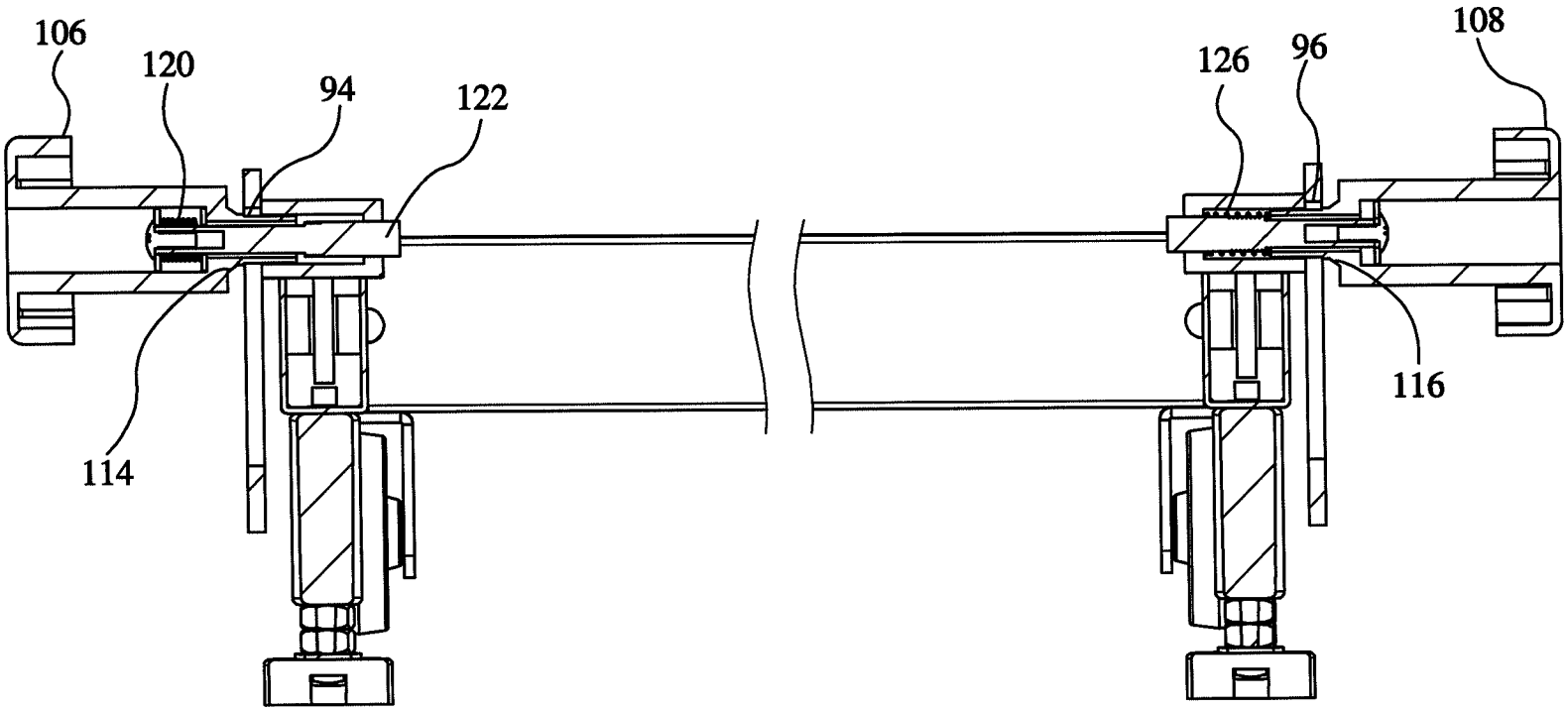

Referring to FIG. 14, when the neck portions 114 and 116 of the first and second operational knobs 106 and 108 are located inside the arc-shaped guide slots 94 and 96 separately, the first and second fasteners 102 and 104 cannot internally move along the arc-shaped guide slots 94 and 96. Referring to FIG. 15, when the user rotates the first and second operational knobs 106 and 108 to enable the first and second springs 120 to have sufficient space for releasing itself; meanwhile, the neck portion 116 of the second operational knob 108 can be forced by the second spring 126 to exit the arc-shaped guide slot 96 and the neck portion 114 remains in the arc-shaped guide slot 94, indicating that the first fastener 102 still fails to move along the arc-shaped guide slot 94 but the second fastener 104 can move along the arc-shaped guide slot 96. Next, referring to FIG. 16, the first operational knob 106 has been released to be movable with respect to the first link 122, so as long as the first operational knob 106 is pulled rearward, the neck portion 114 of the first operational knob 106 can be moved to exit the arc-shaped guide slot 94. In this way, the stand 82 can be collapsed with respect to the support frame 80; when the stand 82 is collapsed to the first specific positions, the user can rotate the first and second operational knobs 106 and 108 to lock the stand 82. Thus, the present invention can conveniently collapse the stand via the first and second positioning assemblies 86 and 90.

It is to be noted that the stand 82 can further include a third positioning assembly 130 in the second preferred embodiment. The third positioning assembly 130 is identical to the third positioning assembly 66 of the first embodiment in structure, action, function, and purpose, so its detailed recitation is skipped.

In addition, the first and second positioning assemblies 86 and 90 set forth in the second preferred embodiment can also be structurally applied to the first, second, and third positioning assemblies 18, 20 & 66, so the collapsible mechanism of the present invention for the treadmill can adopt a variety of structures mentioned above for collapsing the treadmill.

Although the present invention has been described with respect to the specific preferred embodiments thereof, it is in no way limited to the specifics of the illustrated structures but changes and modifications may be made within the scope of the appended claims.

What is claimed is:

1. A collapsible mechanism for a treadmill, comprising:

a support frame;

a stand pivotably attached to the support frame and having a frame body, a first positioning assembly, and a second positioning assembly, the frame body having a bottom side pivotably attached to the support frame, whereby the frame body is collapsible relative to the support frame, the first and second positioning assembly being connected with the frame body and the support frame respectively and located at the bottom side of the support frame, the first positioning assembly having a first fastener and a first sheet member, the second positioning assembly having a second fastener and a second sheet member, the first and second fasteners being mounted onto the support frame, each of the first and second sheet members having an arc-shaped guide slot having two first specific positions, each of arc-shaped climaxes of the arc-shaped guide slots being close to a front side of the first (second) sheet member, each of the two arc-shaped guide slots having two distal ends close to a top side and a bottom side of the first (second) sheet member, respective rear sides of the first and second sheet members being connected with the frame body, the first and second fasteners passing through the arc-shaped guide slots of the first and second sheet members respectively, the first fastener having a first operational knob, the second fastener having a second operational knob, each of the first and second knobs having a head portion and a neck portion, each of the head portions being located at a side of the first (second) sheet member; when each of the neck portions of the first and second fasteners is located at one of the two first specific positions of the arc-shaped guide slot, the stand is set erect relative to the support frame; when each of the neck portions is located at the other first specific position, the stand is set collapsed relative to the support frame; when the neck portions of the first and second operational knobs exit the two first specific positions respectively, the frame body can move along the two arc-shaped guide slots wherein the first positioning assembly further comprises a first sleeve and a first spring; the first fastener further comprises a first link located inside the arc-shaped guide slot of the first sheet member, the first link having an end threadably secured with and located inside the first sleeve, the first spring being sleeved onto the first link and located inside the first sleeve, the first operational knob being mounted onto the first link and located at the other end of the first link to be movable relative to the first link; the second positioning assembly further comprises a second sleeve and a second spring; the second fastener further comprises a second link located inside the arc-shaped guide slot of the second sheet member, the second link having an end threadably secured with the second sleeve and located inside the second sleeve, the other end of the second link being inserted through the head and neck portions of the second operational knob, the head portion of the second operational knob having a chamber for receiving the second spring, the second operational knob being movable relative to the second link; and an operational console pivotably attached to a top side of the frame body and collapsible relative to the stand.

2. The collapsible mechanism as defined in claim 1, wherein the stand further comprises a third positioning assembly having a third fastener and a third sheet member, the third fastener being inserted through the third sheet member, the third sheet member having two second specific positions; when the third fastener is located at one of the second specific positions of the third sheet member, the operational console is set erect relative to the stand; when the third fastener is located at the other second specific position, the operational console is collapsed relative to the stand.

3. The collapsible mechanism as defined in claim 2, wherein the third positioning assembly further comprises a third sleeve, a third spring, and a third operational knob, the third sheet member being connected with the operational console and having an arc-shaped guide slot, the two second specific positions being located at two distal ends of the arc-shaped guide slot, the third fastener being located at a side of the third sheet member for being plugged into one of the two second specific positions of the arc-shaped guide slot of the third sheet member, the third sleeve being located at the other side of the third sheet member and fixedly mounted onto the frame body, the third operational knob passing through the third sleeve and being threadably secured with the third fastener to be movable relative to the third sleeve, the third spring being sleeved onto the third operational knob and located inside the third sleeve.

* * * * *